US008919937B2

(12) United States Patent
Kamiya

(10) Patent No.: US 8,919,937 B2
(45) Date of Patent: Dec. 30, 2014

(54) LIQUID DISCHARGE APPARATUSES

(71) Applicant: Masataka Kamiya, Owariasahi (JP)

(72) Inventor: Masataka Kamiya, Owariasahi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/038,133

(22) Filed: Sep. 26, 2013

(65) Prior Publication Data

US 2014/0092181 A1 Apr. 3, 2014

(30) Foreign Application Priority Data

Sep. 28, 2012 (JP) ..... 2012-218516

(51) Int. Cl.
*B41J 2/175* (2006.01)
*B41J 2/14* (2006.01)

(52) U.S. Cl.
CPC ..... *B41J 2/17523* (2013.01)
USPC ..... 347/85; 347/49

(58) Field of Classification Search
CPC .. B41J 2/1752; B41J 2/17503; B41J 2/17509; B41J 2/17513; B41J 2/17523
USPC ..... 347/19, 49, 84–86
See application file for complete search history.

(56) References Cited

U.S. PATENT DOCUMENTS 6,338,539 B1 * 1/2002 Kobayashi et al. ..... 347/23
6,908,182 B2 * 6/2005 Nakazawa et al. ..... 347/86
7,452,062 B2 * 11/2008 Kimura et al. ..... 347/86
7,922,307 B2 * 4/2011 Kobayashi et al. ..... 347/85

FOREIGN PATENT DOCUMENTS

JP 2006-212808 A 8/2006

* cited by examiner

*Primary Examiner* — Anh T. N. Vo
(74) *Attorney, Agent, or Firm* — Baker Botts L.L.P.

(57) ABSTRACT

A liquid discharge apparatus includes a liquid cartridge and an apparatus main body. The apparatus main body includes needles that are configured to receive peak loads at predetermined intervals in a predetermined order. A greatest load associated with the predetermined order is less than a greatest load associated with each of all others of a plurality of unique orders, the greatest load associated with each unique order corresponding to a greater of the peak load received by a needle receiving the peak load first in each unique order and a sum load of the peak load received by a needle receiving the peak load after the needle receiving the peak load first in each unique order and the steady load received by a needle receiving the peak load before the needle receiving the peak load after the needle receiving the peak load first in each unique order.

3 Claims, 7 Drawing Sheets

Fig.8

| | | | | | | |
|---|---|---|---|---|---|---|
| FIRST NEEDLE | 1 | 1 | 2 | 2 | 3 | 3 |
| SECOND NEEDLE | 2 | 3 | 1 | 3 | 1 | 2 |
| THIRD NEEDLE | 3 | 2 | 3 | 1 | 2 | 1 |
| Mmin | × | × | × | × | ○ | × |

LIQUID DISCHARGE APPARATUSES

CROSS-REFERENCE TO RELATED APPLICATION

This application claims priority to Japanese Patent Application No. 2012-218516, filed on Sep. 28, 2012, the disclosure of which is incorporated herein by reference.

BACKGROUND OF THE DISCLOSURE

1. Field of the Invention

The present invention relates generally to liquid discharge apparatuses and, more specifically, to liquid discharge apparatuses that include a plurality of needles, in which the plurality of needles are configured to penetrate or insert into sealing members of liquid cartridges.

2. Description of the Related Art

An inkjet recording apparatus may include a plurality of rubber membranes that are formed in main tanks. The inkjet recording apparatus may further include an apparatus main body that includes a plurality of liquid supply needles. When the main tanks are attached to the apparatus main body, each of the liquid supply needles may penetrate a corresponding rubber membrane, and the liquid contained in the main tanks may be supplied to a recording head via the liquid supply needles. The liquid supply needles may be configured to easily penetrate the rubber membranes. The liquid supply needles of the inkjet recording device may differ in length. Therefore, each liquid supply needle may penetrate a rubber membrane at a different time. Accordingly, the greatest or maximum value of the load of liquid received by the plurality of liquid supply needles when the plurality of liquid supply needles penetrates the rubber membranes may be reduced.

SUMMARY OF THE DISCLOSURE

According to an embodiment of the invention, a liquid discharge apparatus may comprise a liquid cartridge and an apparatus main body. The liquid cartridge may comprise: a housing; a plurality of liquid reservoirs disposed in the housing, the plurality of liquid reservoirs containing liquid; a plurality of liquid outlet paths configured to communicate with the plurality of liquid reservoirs and output the liquid to outside of the liquid cartridge; and a plurality of sealing members configured to seal the plurality of liquid outlet paths. The apparatus main body may comprise: an attaching portion configured to receive the liquid cartridge such that the liquid cartridge attaches to the attaching portion; and a plurality of needles configured to insert into the plurality of sealing members such that the liquid contained in the plurality of liquid reservoirs is introduced to the outside of the liquid cartridge. The liquid discharge apparatus may further comprise a plurality of sets. Each set of the plurality of sets may comprise a needle of the plurality of needles and a sealing member of the plurality of sealing members, in which the needle of each set is inserted into the sealing member of each set. Each set may be configured to produce a peak load in response to the needle of each set being inserted an initial insertion amount into the sealing member of each set, the peak load corresponding to an increased load produced by each set when the needle of each set is being inserted into the sealing member of each set. Each set may be further configured to produce a steady load when the needle of each set is further inserted into the sealing member of each set, wherein a magnitude of the steady load is maintained when the needle of each set is further inserted into the sealing member of each set. The steady load may be less than the peak load. Moreover, either the peak load produced by a first set of the plurality of sets may be different than the peak load produced by a second set of the plurality of sets or the steady load produced by the first set may be different than the steady load produced by the second set. The plurality of needles may be configured to receive the peak loads at predetermined intervals in a predetermined order. The predetermined order may be one of a plurality of unique orders, in which each unique order of the plurality of unique orders is associated with a greatest load. The greatest load associated with each set may correspond to a greater of the peak load received by a needle of the plurality of needles receiving the peak load first in each unique order and a sum load of the peak load received by a needle of the plurality of needles receiving the peak load after the needle receiving the peak load first in each unique order and the steady load received by a needle of the plurality of needles receiving the peak load before the needle receiving the peak load after the needle receiving the peak load first in each unique order. The greatest load associated with the predetermined order may be less than the greatest load associated each of all others of the plurality of unique orders. The predetermined interval may be determined such that a total load received by the plurality of needles when the plurality of needles is being inserted into the plurality of sealing members is equal to or less than the greatest load of the predetermined order.

According to another embodiment of the invention, a liquid discharge apparatus may comprise a plurality of liquid cartridges and an apparatus main body. Each liquid cartridge of the plurality of liquid cartridges may comprise: a housing; a liquid reservoir disposed in the housing, the liquid reservoir containing liquid; a liquid outlet path configured to communicate with the liquid reservoir and output the liquid to outside of the liquid cartridge; and a sealing member configured to seal the plurality of liquid outlet paths. The apparatus main body may comprise: an attaching portion configured to receive the plurality of liquid cartridges such that the plurality of liquid cartridges attaches to the attaching portion; an attachment detector configured to send a signal in response to the plurality of liquid cartridges attaching to the attaching portion; a plurality of needles configured to insert into the sealing members of the plurality of liquid cartridges such that the liquid contained in the liquid reservoirs of the plurality of liquid cartridges is introduced to the outside of the plurality of liquid cartridges; a needle moving mechanism configured to cause the plurality of needles to move such that the plurality of needles inserts into the sealing members of the plurality of liquid cartridges; and a controller configured to control the needle moving mechanism such that the needle moving mechanism operates based on the signal sent by the attachment detector. The liquid discharge apparatus may further comprise a plurality of sets. Each set of the plurality of sets may comprise a needle of the plurality of needles and a sealing member of a liquid cartridge of the plurality of liquid cartridges, in which the needle of each set is inserted into the sealing member of each set. Each set may be configured to produce a peak load in response to the needle of each set being inserted an initial insertion amount into the sealing member of each set, the peak load corresponding to an increased load produced by each set when the needle of each set is being inserted into the sealing member of each set. Each set may be further configured to produce a steady load when the needle of each set is further inserted into the sealing member of each set, wherein a magnitude of the steady load is maintained when the needle of each set is further inserted into the sealing member of each set. The steady load may be less than the peak load. Moreover, either the peak load produced by a first set of the plurality of sets may be different than the peak load produced by a second set of the plurality of sets or the steady load produced by the first set may be different than the steady load produced by the second set. The needle moving mechanism may comprise: a base, the plurality of needles extending from the base in parallel to each other; and a base moving mechanism configured to move the base such that the plurality of needles move in a direction to insert into the plurality of sealing members. The plurality of needles may be configured to receive the peak loads at predetermined intervals in a predetermined order based on a length of each needle of the plurality of needles in a direction in which each needle extends from the base. The predetermined order may be one of a plurality of unique orders, in which each unique order of the plurality of unique orders is associated with a greatest load. The greatest load associated with each set may correspond to a greater of the peak load received by a needle of the plurality of needles receiving the peak load first in each unique order and a sum load of the peak load received by a needle of the plurality of needles receiving the peak load after the needle receiving the peak load first in each unique order and the steady load received by a needle of the plurality of needles receiving the peak load before the needle receiving the peak load after the needle receiving the peak load first in each unique order. The greatest load associated with the predetermined order may be less than the greatest load associated each of all others of the plurality of unique orders. The predetermined interval may be determined such that a total load received by the plurality of needles when the plurality of needles is being inserted into the sealing members of the plurality of cartridges is equal to or less than the greatest load of the predetermined order.

According to yet another embodiment of the invention, a liquid discharge apparatus may comprise a liquid cartridge and an apparatus main body. The liquid cartridge may comprise: a housing; a first liquid reservoir and a second liquid reservoir disposed in the housing, the first liquid reservoir and the second liquid reservoir containing liquid; a first liquid outlet path and a second outlet path configured to communicate with the first liquid reservoir and the second liquid reservoir, respectively, and output the liquid contained in the first liquid reservoir and the second reservoir to outside of the liquid cartridge; and a first sealing member and a second sealing member configured to seal the first liquid outlet path and the second liquid outlet path, respectively. The apparatus main body may comprise: an attaching portion configured to receive the liquid cartridge such that the liquid cartridge attaches to the attaching portion; and a first needle and a second needle configured to insert into the first sealing member and the second sealing member, respectively, such that the liquid contained in the first liquid reservoir and the second liquid reservoir is introduced to the outside of the liquid cartridge. The first needle and the first sealing member may be configured to produce a first peak load in response to the first needle being inserted an initial insertion amount of the first needle into the first sealing member, the first peak load corresponding to an increased load produced by the first needle and the first sealing member when the first needle is being inserted into the first sealing member. The first needle and the first sealing member may be further configured to produce a first steady load when the first needle is further inserted into the first sealing member, in which a magnitude of the first steady load is maintained when the first needle is further inserted into the first sealing member. The second needle and the second sealing member may be configured to produce a second peak load in response to the second needle being inserted an initial insertion amount of the second needle into the second sealing member, the second peak load corresponding to an increased load produced by the second needle and the second sealing member when the second needle is being inserted into the second sealing member. The second needle and the second sealing member may be further configured to produce a second steady load when the second needle is further inserted into the second sealing member, in which a magnitude of the second steady load is maintained when the second needle is further inserted into the second sealing member. The first steady load may be less than the first peak load, and the second steady load may be less than the second peak load. Moreover, either the first peak load may be different than the second peak load or the first steady load may be different than the second steady load. The first needle and the second needle may be configured to receive the first peak load and the second peak load such that the second needle receives the second peak load after the first needle receives the first peak load. A greater of the first peak load and a sum load of the second peak load and the first steady load may be less than a greater of the second peak load and a sum load of the first peak load and the second steady load, and a total load received by the first needle and the second needle when the first needle and the second needle are being inserted into the first sealing member and the second sealing member, respectively, may be equal to or less than the greater of the first peak load and a sum load of the second peak load and the first steady load.

Other objects, features, and advantages will be apparent to persons of ordinary skill in the art from the following detailed description of embodiments of the invention and the accompanying drawings.

BRIEF DESCRIPTION OF THE DRAWINGS

FIG. 8 is a table illustrating a plurality of possible unique orders of inserting each of a plurality of needles into each of a plurality of sealing members according to an embodiment of the invention.

DETAILED DESCRIPTION OF EMBODIMENTS OF THE INVENTION

Figure 1:
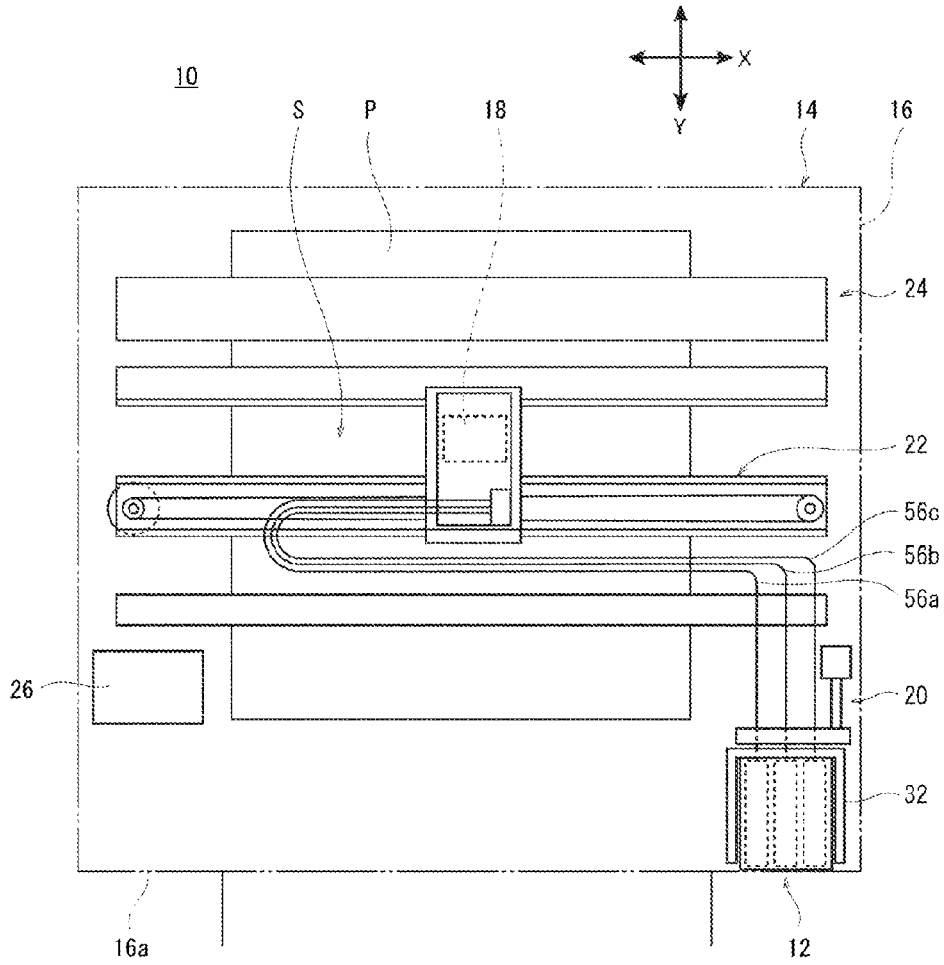
FIG. 1 is a plan view illustrating a configuration of an inkjet printer according to an embodiment of the invention.

Example embodiments are described in detail herein with reference to the accompanying drawings, like reference numerals being used for like corresponding parts in the various drawings.

The present disclosure may be applied to an inkjet recording apparatus. The inkjet recording apparatus may include a plurality of liquid supply needles, which are different in thickness from one another. The liquid supply needles may be configured to receive a load of liquid from a liquid cartridge having a rubber membrane. The load that each liquid supply needle receives and the timing at which such load becomes the greatest may vary depending on a number of factors such as the thickness or diameter of the liquid supply needles, shapes of the tips of the needles, shapes of the rubber membranes that the liquid supply needles penetrate, and so forth. Thus, when a plurality of needles in an inkjet recording apparatus has different characteristics (e.g., thickness, tip shapes), it may be difficult to keep the total load received by the plurality of needles small by only varying the timing that each of the plurality of needles penetrates or inserts into a corresponding ink cartridge.

Embodiments of the present invention provide a liquid discharge apparatus that is capable of keeping a greatest or maximum value of the total load simultaneously received by a plurality of needles small even when each of the plurality of needles have different characteristics (e.g., thickness, tip shape).

In the present disclosure, a "liquid discharge apparatus" may be an inkjet printer that discharges a liquid (e.g., ink) onto a surface of a recording medium (e.g., paper sheet) to form an image. The inkjet printer may have additional functions such as scanning and copying. Thus, the inkjet printer may also be a scanner or a copy machine.

Figure 2:
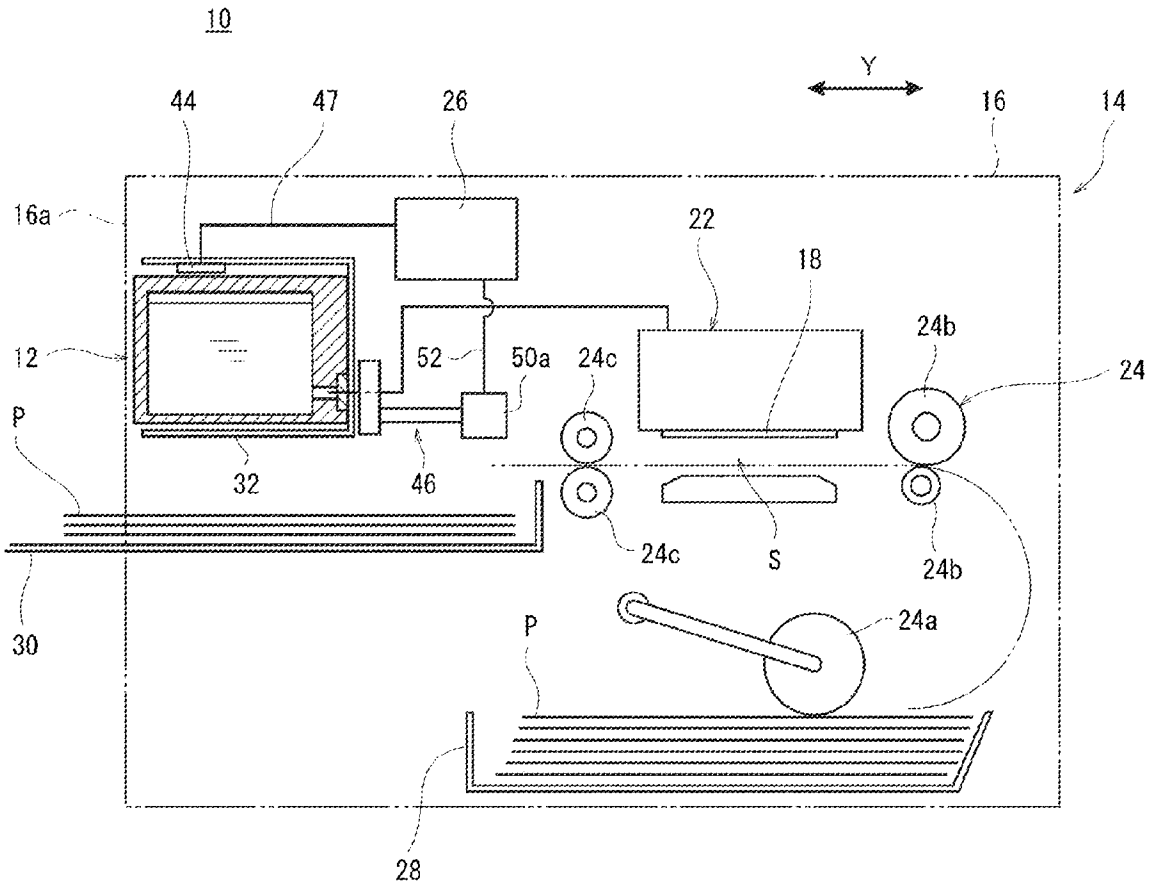
FIG. 2 is a side view illustrating the configuration of the inkjet printer according to an embodiment of the invention.

FIG. 1 is a plan view of an inkjet printer 10 according to an embodiment of the present invention. FIG. 2 is a side view of the inkjet printer 10. As illustrated in FIGS. 1 and 2, the inkjet printer 10 may include an ink cartridge 12 (e.g., a liquid cartridge) that contains ink and an apparatus main body 14. The apparatus main body 14 may include a printer housing 16; an ink discharge head 18, which may discharge ink onto a surface of a paper sheet P; an ink supply device 20, which may supply ink to the ink discharge head 18; a scanner device 22, which may cause the ink discharge head 18 to discharge ink in a reciprocating manner; a paper conveying device 24, which may convey the paper sheet P to a scanning region S of the ink discharge head 18; and a control device 26, which may execute various kinds of control. The inkjet printer 10 may further include a feed tray 28 in which one or more paper sheets P are contained; and an output tray 30, which may receive one or more paper sheets P on which an image has been formed. The components of the inkjet printer 10 may be contained or housed within the printer housing 16 with a part of the output tray 30 protruding from a front surface 16*a* of the printer housing 16.

In FIG. 1, a legend defines a main scanning direction X as a direction in which the ink discharge head 18 reciprocates (e.g., moves in a reciprocating manner) and a sub-scanning direction Y as a direction that is perpendicular to the main scanning direction X.

As illustrated in FIG. 2, a paper sheet P contained in the feed tray 28 may be conveyed by a pickup roller 24*a* and a conveyance roller pair 24*b*, 24*b* of the paper conveying device 24 along the sub-scanning direction Y to reach a scanning region S. Once the paper reaches the scanning region S, an image may be formed on a surface of the paper sheet P with ink discharged from the ink discharge head 18. The paper sheet P on which the image has been formed may be output by an output roller pair 24*c*, 24*c* to the output tray 30.

Figure 3:
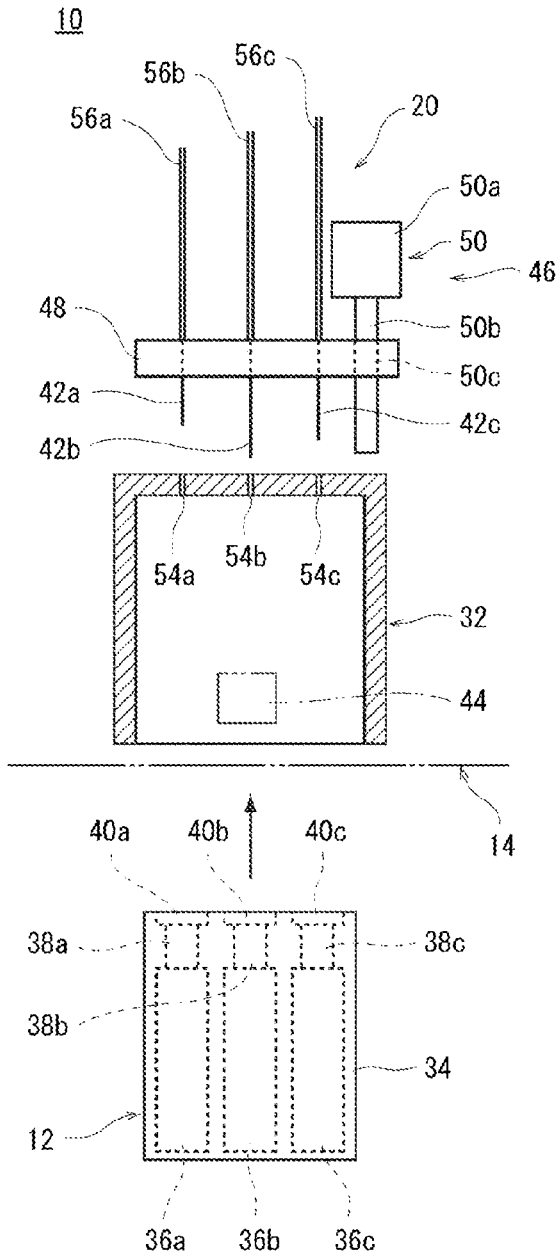
FIG. 3 is a plan view illustrating a configuration of an ink cartridge and an attaching portion an embodiment of the invention.

FIG. 3 is a plan view of the ink cartridge 12 (e.g., the liquid cartridge) and an attaching portion 32 thereof. As illustrated in FIG. 3, the ink cartridge 12 may include a housing 34; a plurality of ink reservoirs 36*a*, 36*b*, 36*c* (e.g., liquid reservoirs) contained or disposed in the housing 34; a plurality of ink outlet paths 38*a*, 38*b*, 38*c* (e.g., liquid outlet paths), each of which communicates with each of the ink reservoirs 36*a*, 36*b*, 36*c* and outputs ink contained in the ink reservoirs 36*a*, 36*b*, 36*c* to the outside; and a plurality of sealing members 40*a*, 40*b*, 40*c* for sealing the ink outlet paths 38*a*, 38*b*, 38*c*. The plurality of sealing members 40*a*, 40*b*, 40*c* may comprise, for example, rubber membranes. The ink cartridge 12 may be an integrated ink cartridge, in which a plurality of ink reservoirs 36*a*, 36*b*, 36*c* containing different colors of ink is assembled in an integrated manner.

Further, as illustrated in FIG. 3, the ink supply device 20 of the apparatus main body 14 may include the attaching portion 32 to which the ink cartridge 12 is attached; and a plurality of needles 42*a*, 42*b*, 42*c*, each of which is inserted into one of the sealing members 40*a*, 40*b*, 40*c* of the ink cartridge 12 attached to the attaching portion 32 so that the ink contained in the ink reservoirs 36*a*, 36*b*, 36*c* of the ink cartridge 12 is introduced to outside of the ink cartridge 12. The ink supply device 20 may include an attachment detecting device 44 (e.g., an attaching detector), which may send a signal in response to the ink cartridge 12 attaching to the attaching portion 32; a needle moving mechanism 46, which may cause the needles 42*a*, 42*b*, 42*c* to move to penetrate and insert into each of the sealing members 40*a*, 40*b*, 40*c*; and a control device 26 (depicted in FIG. 2), which may control the needle moving mechanism 46 to operate in accordance with the signal sent from the attachment detecting device 44. As illustrated in FIG. 2, the attachment detecting device 44 and the control device 26 may be electrically connected to each other via a signal line 47.

As illustrated in FIG. 3, the needle moving mechanism 46 includes a base 48 in which the needles 42*a*, 42*b*, 42*c* may be arranged upright and in parallel with one another (e.g., the needles 42*a*, 42*b*, 42*c* extend from the base in parallel to each other); and a base moving mechanism 50, which may move the base 48 such that the needles 42*a*, 42*b*, 42*c* move in a direction to penetrate and insert into the sealing members 40*a*, 40*b*, 40*c*. The base moving mechanism 50 may include a motor 50*a* and a feed screw 50*b* (e.g., a male screw) that is rotated by the motor 50*a*. The feed screw 50*b* may be screwed into a female screw 50*c* formed in the base 48. As illustrated in FIG. 2, because the motor 50*a* and the control device 26 may be electrically connected via a signal line 52, the rotation of the motor 50*a* may be controlled by the control device 26.

When the motor 50*a* is rotated in a forward direction, the feed screw 50*b* may be rotated in the forward direction and the base 48 may be moved in a direction to approach the attaching portion 32. As a result, the needles 42*a*, 42*b*, 42*c* may be inserted into a plurality of needle insertion holes 54*a*, 54*b*, 54*c* formed in the attaching portion 32 and may protrude into an internal space of the attaching portion 32. When the motor 50*a* is rotated in a reverse direction, the feed screw 50*b* may be rotated in the reverse direction and the base 48 may be moved in a direction to be separated from the attaching portion 32. As a result, the needles 42*a*, 42*b*, 42*c* may be drawn from the needle insertion holes 54*a*, 54*b*, 54*c* formed in the attaching portion 32 and may be retracted from the internal space of the attaching portion 32.

As illustrated in FIG. 3, each of the needles 42*a*, 42*b*, 42*c* may be a tubular member which includes on the inside an ink flow channel (not depicted). Each of the needles 42*a*, 42*b*, 42*c* may communicate with a corresponding sub-tank (not depicted) provided in the ink discharge head 18 (depicted in FIG. 1) via one of the ink tubes 56*a*, 56*b*, 56*c*. When the motor 50*a* is rotated in the forward direction in a state in which the attaching portion 32 is attached to the ink cartridge 12, the needles 42*a*, 42*b*, 42*c* may be made to protrude into the internal space of the attaching portion 32 and penetrate corresponding sealing members of the sealing members 40*a*, 40*b*, 40*c* of the ink cartridge 12. In such fashion, the ink reservoirs 36*a*, 36*b*, 36*c* of the ink cartridge 12 and the corresponding sub-tanks (not depicted) provided in the ink discharge head 18 (depicted in FIG. 1) are made to communicate with one another and, thereby, the ink contained in each of the ink reservoirs 36*a*, 36*b*, 36*c* may be supplied to the ink discharge head 18 (depicted in FIG. 1).

Figure 4:
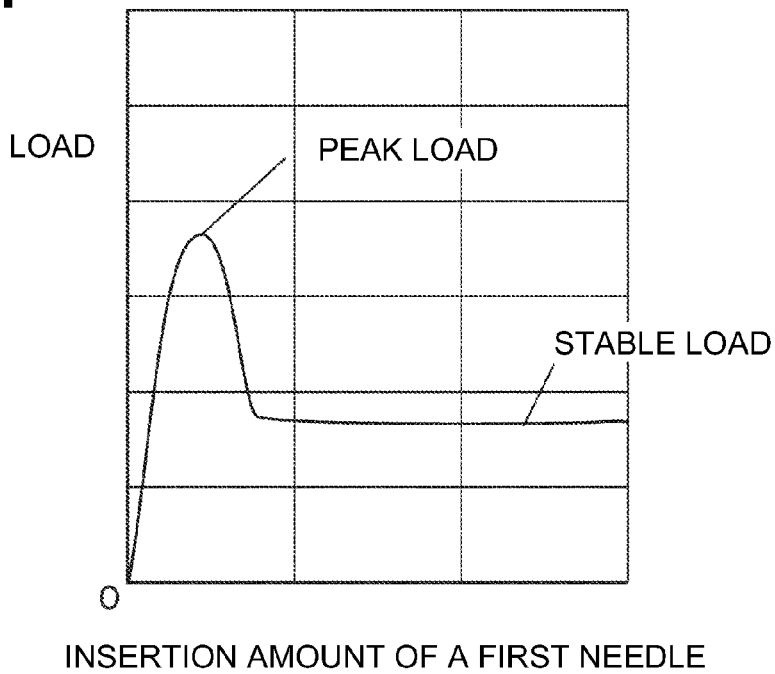
FIG. 4 is a graph illustrating a relationship between an insertion amount of a first needle and a load received by the first needle according to an embodiment of the invention.
Figure 5:
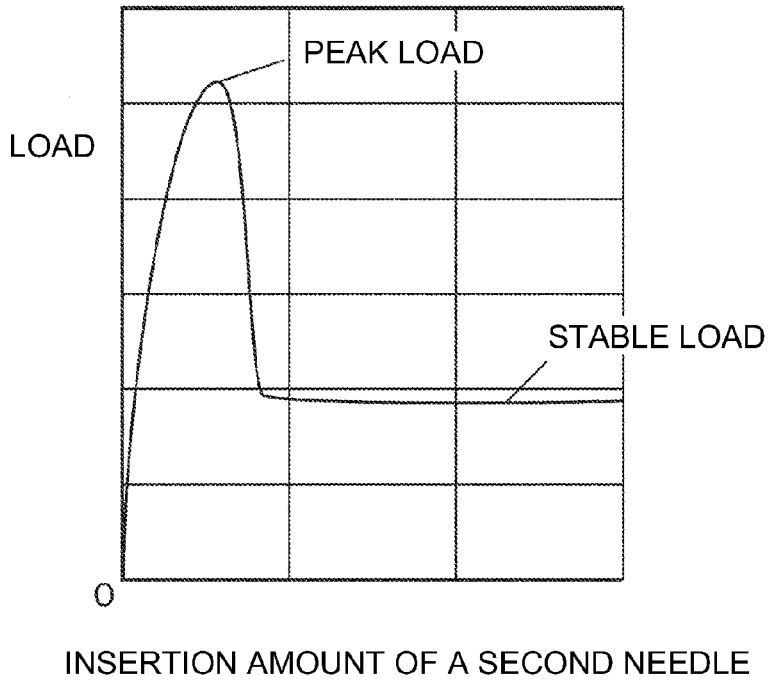
FIG. 5 is a graph illustrating a relationship between an insertion amount of a second needle and a load received by the second needle according to an embodiment of the invention.
Figure 6:
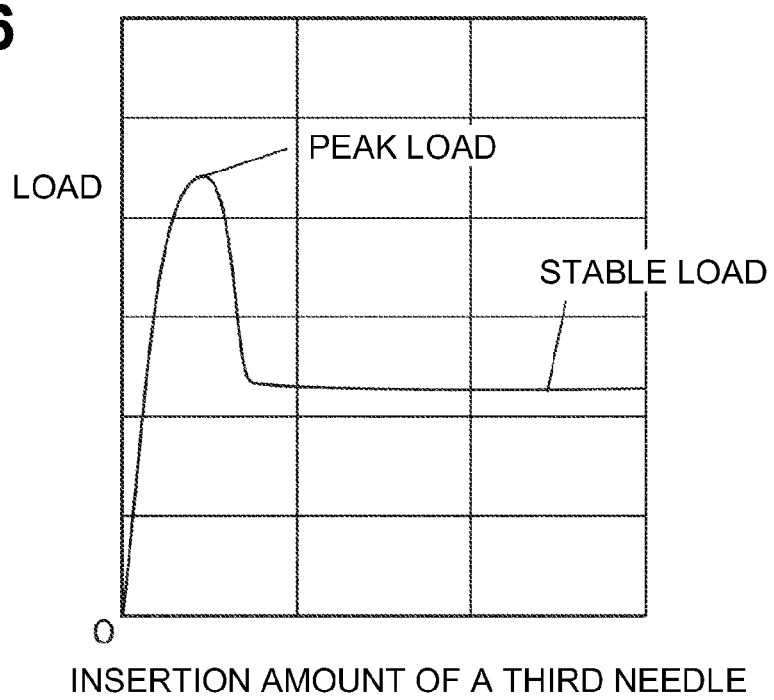
FIG. 6 is a graph illustrating a relationship between an insertion amount of a third needle and a load received by the third needle according to an embodiment of the invention.

FIG. 4 is a graph illustrating a relationship between an insertion amount of a first needle, for example, the needle 42*a*, and a load received by the first needle. FIG. 5 is a graph illustrating a relationship between an insertion amount of a second needle, for example, the needle 42*b*, and load received by the second needle. FIG. 6 is a graph illustrating a relationship between an insertion amount of a third needle, for example, the needle 42*c*, and load received by the third needle. Each one of the needles 42*a*, 42*b*, 42*c* and a corresponding sealing member of the sealing members 40*a*, 40*b*, 40*c* configured to be penetrated by one of the needles 42*a*, 42*b*, 42*c* may form a set. Each set may be configured to produce peak load and a stable load. When each of the needles 42*a*, 42*b*, 42*c* penetrates one of the sealing members 40*a*, 40*b*, 40*c* (e.g., when each of the needles 42*a*, 42*b*, 42*c* is inserted an initial insertion amount), each of the needles 42*a*, 42*b*, 42*c* may receive the peak load. The peak load may correspond to an increased load (e.g., a largest load) received by each of the needles 42*a*, 42*b*, 42*c* when each of the needles 42*a*, 42*b*, 42*c* is inserted into one of the sealing members 40*a*, 40*b*, 40*c*. When each of the needles 42*a*, 42*b*, 42*c* having penetrated one of the sealing members 40*a*, 40*b*, 40*c* is further inserted into the sealing members 40*a*, 40*b*, 40*c*, each of the needles 42*a*, 42*b*, 42*c* may receive the stable load. The stable load may be smaller than the peak load and may have smaller fluctuations.

As illustrated in FIG. 4, a first set comprising the needle 42*a* (the leftmost needle of the needles 42*a*, 42*b*, 42*c* depicted in FIG. 3) and the sealing member 40*a* may be configured to produce a peak load (e.g., an increased or largest load) when the needle 42*a* penetrates the sealing member 40*a* (e.g., in response to the needle 42*a* being inserted an initial insertion amount into the sealing member 40*a*). The first set may be further configured to produce a stable load, which is less than the peak load and fluctuates less than the peak load, when the needle 42*a* having penetrated the sealing member 40*a* is further inserted into the sealing member 40*a*. As illustrated in FIG. 5, a second set comprising the needle 42*b* (the center needle of the needles 42*a*, 42*b*, 42*c* depicted in FIG. 3) and the sealing member 40*b* may be configured to produce a peak load (e.g., an increased or largest load) when the needle 42*b* penetrates the sealing member 40*b* (e.g., in response to the needle 42*b* being inserted an initial insertion amount into the sealing member 40*b*). The second set may be further configured to produce a stable load, which is less than the peak load and fluctuates less than the peak load, when the needle 42*b* having penetrated the sealing member 40*b* is further inserted into the sealing member 40*b*. As illustrated in FIG. 6, a third set comprising the needle 42*c* (the rightmost needle of the needles 42*a*, 42*b*, 42*c* depicted in FIG. 3) and the sealing member 40*c* may be configured to produce a peak load (e.g., an increased or largest load) when the needle 42*c* penetrates the sealing member 40*c* (e.g., in response to the needle 42*c* being inserted an initial insertion amount into the sealing member 40*c*). The third set may be further configured to produce a stable load, which is less than the peak load and fluctuates less than the peak load, when the needle 42*c* having penetrated the sealing member 40*c* is further inserted into the sealing member 40*c*.

As illustrated in FIG. 3, the needles 42*a*, 42*b*, 42*c* are configured to insert sequentially (e.g., insert in a predetermined order) into each of the sealing members 40*a*, 40*b*, 40*c* of the ink cartridge 12 attached to the attaching portion 32. Specifically, the needles 42*a*, 42*b*, 42*c* are configured to insert into the sealing members 40*a*, 40*b*, 40*c* such that a subsequent needle is made to penetrate a sealing member to receive the peak load when a preceding needle is receiving the stable load. In the present embodiment of the invention, the needles 42*a*, 42*b*, 42*c* may differ in length from one another so as to satisfy this condition, which may be referred to as a "first condition."

Figure 7:
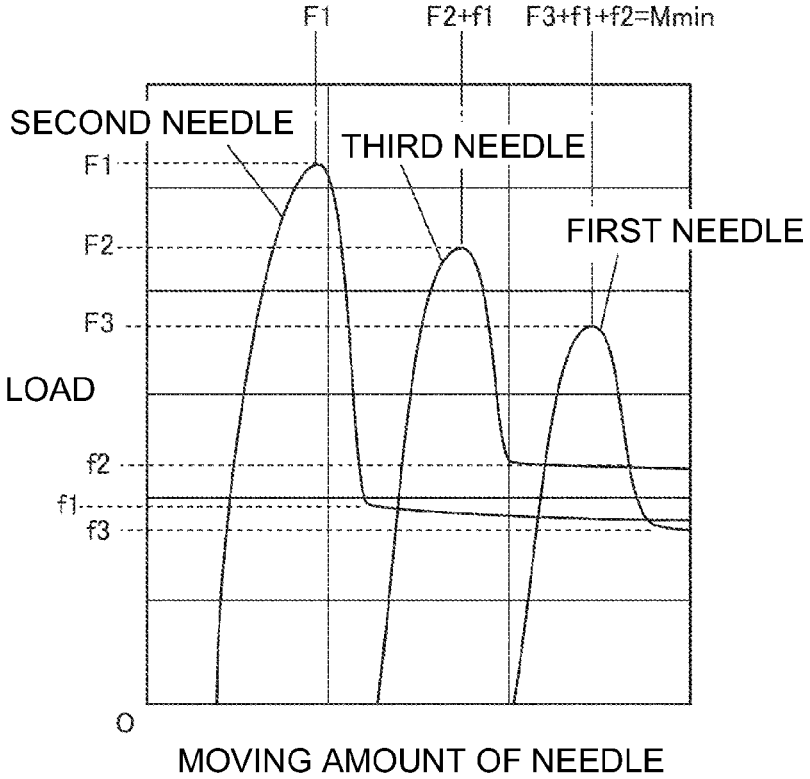
FIG. 7 is a graph illustrating the order in which a greatest amount of a total load received by a plurality of needles is minimized according to an embodiment of the invention.

FIG. 8 is a table illustrating all possible orders of penetration of the needles 42*a*, 42*b*, 42*c* into the sealing members 40*a*, 40*b*, 40*c* (e.g., all possible orders in which the needles 42*a*, 42*b*, 42*c* are inserted into the sealing members 40*a*, 40*b*, 40*c*). The fifth order, depicted in the second column from the right, corresponds to the order in which a maximum value M of the total load (e.g., a greatest load) is smallest of the least among the plurality of possible orders (e.g., a greatest load associated with the fifth order is less than a greatest load associated with each of all other possible orders). The maximum value M associated with the fifth order may be referred to as "a minimum value Mmin." FIG. 7 is a graph illustrating a total load received by the needles 42*a*, 42*b*, 42*c* (depicted in FIG. 3) when the needles 42*a*, 42*b*, 42*c* are inserted into the sealing members 40*a*, 40*b*, 40*c* according to a specific order (specifically, the fifth order) among the possible orders (depicted in FIG. 8). The needles 42*a*, 42*b*, 42*c* (depicted in FIG. 3) may be configured to be inserted into the sealing members 40*a*, 40*b*, 40*c* in the specific order, the specific order corresponding to the order among the possible orders in which the needles 42*a*, 42*b*, 42*c* penetrates the sealing members 40*a*, 40*b*, 40*c* in which the maximum value M of the total load received by the needles 42*a*, 42*b*, 42*c* becomes the smallest. In the present embodiment of the invention, the needles 42*a*, 42*b*, 42*c* may also differ in length from one another so as to satisfy this additional condition, which may be referred to as a "second condition."

An example method for configuring the needles 42*a*, 42*b*, 42*c* so as to satisfy the second condition is described herein. According to the method, the number of the sealing members and the number of the needles may be set to a variable x, where $x \geq 2$ (specifically, x=3 in the present embodiment). Each of the peak loads (e.g., loads having a maximum value) that the needles receive when penetrating the sealing members may be set to a variable Fx (e.g., F1, F2, F3, and so on and so forth) based on an order of penetration, where $x \geq 2$ (specifically, x=3 in the present embodiment). Thus, for example, in the present embodiment, when the order or penetration involves penetrating the needle 42*b* (e.g., the second needle) first, the needle 42*c* (e.g., the third needle) second, and the needle 42*a* (e.g., the first needle) third (as depicted in FIG. 7), then the peak load received by the needle 42*b* would be set to the variable F1, the peak load received by the needle 42*c* would be set to the variable F2, and the peak load received by the needle 42*a* would be set to the variable F3. Each of the stable loads (e.g., loads having a stable or steady value) that the needles receive when the needles having penetrated the sealing members are being further inserted into the sealing members may be set to a variable fx (e.g., f1, f2, f3, and so on and so forth) based on the order of penetration, where $x \geq 2$ (specifically, x=3 in the present embodiment). In a case in which subsequent needles are inserted in the sealing members while preceding needles have produced stable values, the total load which all the needles receive simultaneously may be equal to the sum of the peak load of the subsequent needle and the steady loads of the preceding needles. Thus, for example, in FIG. 7, when subsequent needles 42*a*, 42*c* are inserted into the sealing members 42*a*, 42*c*, the total load received by all of the needles 42*a*, 42*b*, 42*c* may be equal to F3+f1+f2 and F2+f1, respectively. The maximum value of the total load (e.g., a greatest load) may be set to M.

The maximum values M may be obtained for all the possible orders of penetration. In the present embodiment, for example, six possible orders of penetration (as depicted in FIG. 8) exist. After determining the maximum values M of all the possible orders of penetration, the needles are configured to satisfy the second condition (e.g., a condition in which the sealing members are penetrated so as to produce the minimum among the maximum values M for all the possible orders of penetration).

As noted above, FIG. 8 is a table illustrating all the possible orders of penetration of the needles 42*a*, 42*b*, 42*c* (depicted in FIG. 3) into each of the sealing members 40*a*, 40*b*, 40*c* (depicted in FIG. 3). In this embodiment of the invention, since the number of the sealing members 40*a*, 40*b*, 40*c* and the needles 42*a*, 42*b*, 42*c* is three (i.e., the variable x equals 3), the number of possible orders is six. Recalling that the relationships between the insertion amount of each of the needles 42*a*, 42*b*, 42*c* and the load received by each of the needles 42*a*, 42*b*, 42*c* have the characteristics represented in the graphs of FIGS. 4-6, the minimum value Mmin may be obtained when the needles are inserted in the following order: the second needle 42*b* followed by the third needle 42*c* followed by the first needle 42*a* (the order depicted in the second column from the right in FIG. 8). This order may be referred to as a "predetermined order." In order to obtain this order, the needles 42*a*, 42*b*, 42*c* are thus configured such that the needle 42*b* is the longest, the needle 42*c* is the second longest, and the needle 42*a* is the shortest.

Accordingly, in the present embodiment, the needles 42*a*, 42*b*, 42*c* are configured to be inserted into the sealing members 40*a*, 40*b*, 40*c* in an order among several possible orders in which the needles 42*a*, 42*b*, 42*c* may penetrate the sealing members 40*a*, 40*b*, 40*c* that produces a maximum value M that is smaller or less than the maximum values M of all the other possible orders (e.g., the minimum value Mmin). By configuring the needles 42*a*, 42*b*, 42*c* in this way, the maximum value M of the total load that the needles 42*a*, 42*b*, 42*c* receive may be kept small, regardless of the individual characteristics of the needles 42*a*, 42*b*, 42*c*. By reducing the total load received by the needles 42*a*, 42*b*, 42*c*, the load that is supported by the needle moving mechanism 46 is similarly reduced and the size of the motor 50*a* may be reduced.

In the present embodiment, the total load that all the needles 42*a*, 42*b*, 42*c* receive simultaneously may vary from F1 to F2+f1 to F3+f1+f2 as the needles 42*a*, 42*b*, 42*c* penetrate the sealing members 40*a*, 40*b*, 40*c*. The maximum value M of the total load may be F3+f1+f2. However, if the time interval between the insertion of a preceding needle into a sealing member and the insertion of a subsequent needle into a sealing member is short, a situation may arise where the total load becomes greater than any of F1, F2+f1, and F3+f1+f2. In such case, a maximum value M of the total load may be obtained by performing additional tests or calculations.

In the embodiment described above, the needles 42*a*, 42*b*, 42*c* may be inserted in the sealing members 40*a*, 40*b*, 40*c* automatically using the needle moving mechanism 46 or inserted manually. When the needles 42*a*, 42*b*, 42*c* are inserted manually, the needles 42*a*, 42*b*, 42*c* may be fixed in the internal space of the attaching portion 32. Thus, when the ink cartridge 12 is manually attached to the attaching portion 32, each of the needles 42*a*, 42*b*, 42*c* is inserted into each corresponding one of the sealing members 40*a*, 40*b*, 40*c*. In the case of manual insertion, the needles 42*a*, 42*b*, 42*c* may still be configured to satisfy both the first condition and the second condition described above.

Figure 9:
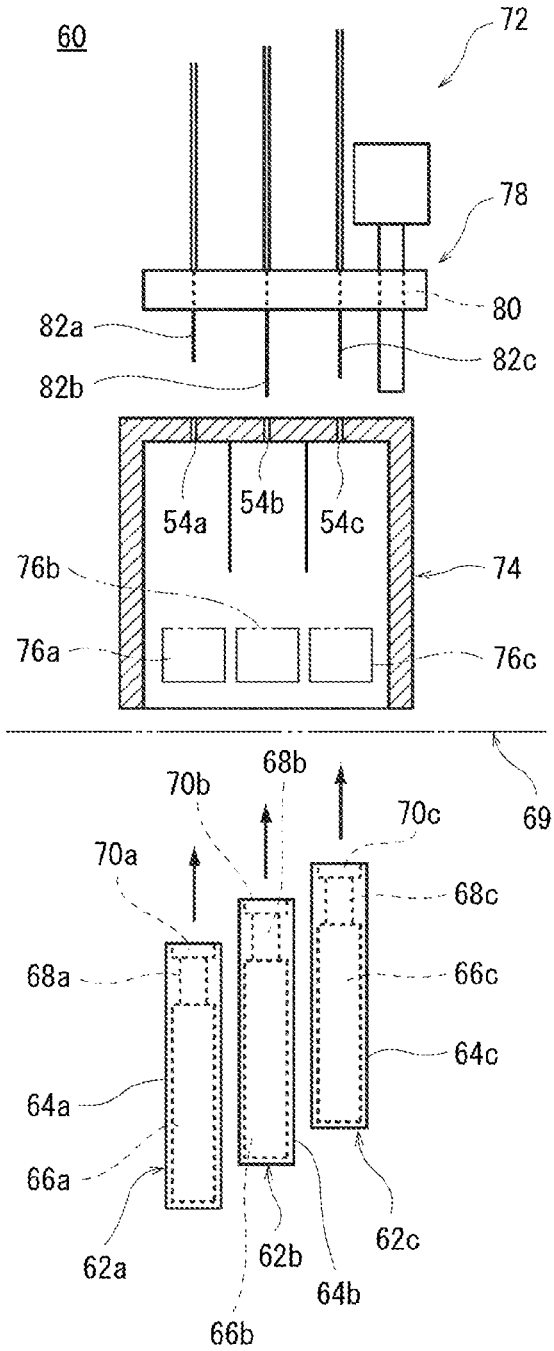
FIG. 9 is a plan view illustrating a configuration of a plurality of ink cartridges and an attaching portion in an inkjet printer according to another embodiment of the invention.

FIG. 9 is a plan view of a plurality of ink cartridges 62*a*, 62*b*, 62*c* (e.g., liquid cartridges) and an attaching portion 74 of an inkjet printer 60 (i.e., liquid discharge apparatus) according to another embodiment of the invention. As illustrated in FIG. 9, the inkjet printer 60 according to this embodiment may include the plurality of ink cartridges 62*a*, 62*b*, 62*c*. The ink cartridges 62*a*, 62*b*, 62*c* may include housings 64*a*, 64*b*, 64*c*; ink reservoirs 66*a*, 66*b*, 66*c* (e.g., liquid reservoirs) contained or disposed in the housings 64*a*, 64*b*, 64*c*; ink outlet paths 68*a*, 68*b*, 68*c* (e.g., liquid outlet paths), which may communicate with the ink reservoirs 66*a*, 66*b*, 66*c* and output ink (e.g., liquid) to the outside; and sealing members 70*a*, 70*b*, 70*c*, which may seal the ink outlet paths 68*a*, 68*b*, 68*c*. An ink supply device 72 provided in an apparatus main body 69 of the inkjet printer 60 may include an attaching portion 74 to which the ink cartridges 62*a*, 62*b*, 62*c* are individually attached; and attachment detecting devices 76*a*, 76*b*, 76*c*, which may send signals in response to the ink cartridges 62*a*, 62*b*, 62*c* attaching to the attaching portion 74. A control device (not illustrated) controls a needle moving mechanism 78 in accordance with the signals sent by the attachment detecting devices 76*a*, 76*b*, 76*c*. The configuration of the needle moving mechanism 78 may be substantially similar to that of the needle moving mechanism 46 (depicted in FIG. 3). The configuration of the needles 82*a*, 82*b*, 82*c* that are arranged upright in a base 80 of the needle moving mechanism 78 may also be substantially similar to that of the needles 42*a*, 42*b*, 42*c* (depicted in FIG. 3). That is, the needles 82*a*, 82*b*, 82*c* may also be configured to satisfy both the first condition and second condition described above.

While the invention has been described in connection with various exemplary structures and illustrative configurations, it will be understood by those skilled in the art that other variations and modifications of the structures, configurations, and embodiments disclosed above may be made without departing from the scope of the invention. Other structures, configurations, and embodiments consistent with the scope of the claimed invention will be apparent to those skilled in the art from a consideration of the specification or practice of the invention disclosed herein. It is intended that the specification and the described examples are illustrative with the true scope of the invention being defined by the following claims.

What is claimed is:

1. A liquid discharge apparatus comprising:

a liquid cartridge comprising:

a housing;

a plurality of liquid reservoirs disposed in the housing, the plurality of liquid reservoirs containing liquid;

a plurality of liquid outlet paths configured to communicate with the plurality of liquid reservoirs and output the liquid to outside of the liquid cartridge; and a plurality of sealing members configured to seal the plurality of liquid outlet paths;

an apparatus main body comprising:

an attaching portion configured to receive the liquid cartridge such that the liquid cartridge attaches to the attaching portion; and a plurality of needles configured to insert into the plurality of sealing members such that the liquid contained in the plurality of liquid reservoirs is introduced to the outside of the liquid cartridge; and a plurality of sets, each set of the plurality of sets comprising a needle of the plurality of needles and a sealing member of the plurality of sealing members, wherein the needle of each set is inserted into the sealing member of each set, wherein each set is configured to produce a peak load in response to the needle of each set being inserted an initial insertion amount into the sealing member of each set, the peak load corresponding to an increased load produced by each set when the needle of each set is being inserted into the sealing member of each set, wherein each set is further configured to produce a steady load when the needle of each set is further inserted into the sealing member of each set, wherein a magnitude of the steady load is maintained when the needle of each set is further inserted into the sealing member of each set, the steady load being less than the peak load, wherein either the peak load produced by a first set of the plurality of sets is different than the peak load produced by a second set of the plurality of sets or the steady load produced by the first set is different than the steady load produced by the second set, wherein the plurality of needles is configured to receive the peak loads at predetermined intervals in a predetermined order, wherein the predetermined order is one of a plurality of unique orders, each unique order of the plurality of unique orders associated with a greatest load, the greatest load associated with each set corresponding to a greater of the peak load received by a needle of the plurality of needles receiving the peak load first in each unique order and a sum load of the peak load received by a needle of the plurality of needles receiving the peak load after the needle receiving the peak load first in each unique order and the steady load received by a needle of the plurality of needles receiving the peak load before the needle receiving the peak load after the needle receiving the peak load first in each unique order, wherein the greatest load associated with the predetermined order is less than the greatest load associated with each of all others of the plurality of unique orders, wherein the predetermined interval is determined such that a total load received by the plurality of needles when the plurality of needles is being inserted into the plurality of sealing members is equal to or less than the greatest load of the predetermined order, wherein the apparatus main body further comprises:

an attachment detector configured to send a signal in response to the liquid cartridge attaching to the attaching portion;

a needle moving mechanism configured to cause the plurality of needles to move such that the plurality of needles inserts into the plurality of sealing members; and a controller configured to control the needle moving mechanism such that the needle moving mechanism operates based on the signal sent by the attachment detector, wherein the needle moving mechanism comprises:

a base, the plurality of needles extending from the base parallel to each other; and a base moving mechanism configured to move the base such that the plurality of needles moves in a direction to insert into the plurality of sealing members, and wherein the plurality of needles is configured to receive the peak loads at the predetermined intervals in the predetermined order based on a length of each needle of the plurality of needles in a direction in which each needle extends from the base.

2. A liquid discharge apparatus comprising:

a plurality of liquid cartridges, each liquid cartridge of the plurality of liquid cartridges comprising:

a housing;

a liquid reservoir disposed in the housing, the liquid reservoir containing liquid;

a liquid outlet path configured to communicate with the liquid reservoir and output the liquid to outside of the liquid cartridge; and a sealing member configured to seal the liquid outlet path;

an apparatus main body comprising:

an attaching portion configured to receive the plurality of liquid cartridges such that the plurality of liquid cartridges attaches to the attaching portion; and an attachment detector configured to send a signal in response to the plurality of liquid cartridges attaching to the attaching portion;

a plurality of needles configured to insert into the sealing members of the plurality of liquid cartridges such that the liquid contained in the liquid reservoirs of the plurality of liquid cartridges is introduced to the outside of the plurality of liquid cartridges;

a needle moving mechanism configured to cause the plurality of needles to move such that the plurality of needles inserts into the sealing members of the plurality of liquid cartridges; and a controller configured to control the needle moving mechanism such that the needle moving mechanism operates based on the signal sent by the attachment detector;

a plurality of sets, each set of the plurality of sets comprising a needle of the plurality of needles and a sealing member of a liquid cartridge of the plurality of liquid cartridges, wherein the needle of each set is inserted into the sealing member of each set, wherein each set is configured to produce a peak load in response to the needle of each set being inserted an initial insertion amount into the sealing member of each set, the peak load corresponding to an increased load produced by each set when the needle of each set is being inserted into the sealing member of each set, wherein each set is further configured to produce a steady load when the needle of each set is further inserted into the sealing member of each set, wherein a magnitude of the steady load is maintained when the needle of each set is further inserted into the sealing member of each set, the steady load being less than the peak load, wherein either the peak load produced by a first set of the plurality of sets is different than the peak load produced by a second set of the plurality of sets or the steady load produced by the first set is different than the steady load produced by the second set, wherein the needle moving mechanism comprises:

a base, the plurality of needles extending from the base parallel to each other; and a base moving mechanism configured to move the base such that the plurality of needles move in a direction to insert into the plurality of sealing members, wherein the plurality of needles is configured to receive the peak loads at predetermined intervals in a predetermined order based on a length of each needle of the plurality of needles in a direction in which each needle extends from the base, wherein the predetermined order is one of a plurality of unique orders, each unique order of the plurality of unique orders associated with a greatest load, the greatest load associated with each set corresponding to a greater of the peak load received by a needle of the plurality of needles receiving the peak load first in each unique order and a sum load of the peak load received by a needle of the plurality of needles receiving the peak load after the needle receiving the peak load first in each unique order and the steady load received by a needle of the plurality of needles receiving the peak load before the needle receiving the peak load after the needle receiving the peak load first in each unique order, wherein the greatest load associated with the predetermined order is less than the greatest load associated with each of all others of the plurality of unique orders, and wherein the predetermined interval is determined such that a total load received by the plurality of needles when the plurality of needles is being inserted into the sealing members of the plurality of cartridges is equal to or less than the greatest load of the predetermined order.

3. A liquid discharge apparatus, comprising:

a liquid cartridge comprising:

a housing;

a first liquid reservoir and a second liquid reservoir disposed in the housing, the first liquid reservoir and the second liquid reservoir containing liquid;

a first liquid outlet path and a second outlet path configured to communicate with the first liquid reservoir and the second liquid reservoir, respectively, and output the liquid contained in the first liquid reservoir and the second reservoir to outside of the liquid cartridge; and a first sealing member and a second sealing member configured to seal the first liquid outlet path and the second liquid outlet path, respectively; and an apparatus main body comprising:

an attaching portion configured to receive the liquid cartridge such that the liquid cartridge attaches to the attaching portion; and a first needle and a second needle configured to insert into the first sealing member and the second sealing member, respectively, such that the liquid contained in the first liquid reservoir and the second liquid reservoir is introduced to the outside of the liquid cartridge, wherein the first needle and the first sealing member are configured to produce a first peak load in response to the first needle being inserted an initial insertion amount of the first needle into the first sealing member, the first peak load corresponding to an increased load produced by the first needle and the first sealing member when the first needle is being inserted into the first sealing member, wherein the first needle and the first sealing member are further configured to produce a first steady load when the first needle is further inserted into the first sealing member, wherein a magnitude of the first steady load is maintained when the first needle is further inserted into the first sealing member, the first steady load being less than the first peak load, wherein the second needle and the second sealing member are configured to produce a second peak load in response to the second needle being inserted an initial insertion amount of the second needle into the second sealing member, the second peak load corresponding to an increased load produced by the second needle and the second sealing member when the second needle is being inserted into the second sealing member, wherein the second needle and the second sealing member are further configured to produce a second steady load when the second needle is further inserted into the second sealing member, wherein a magnitude of the second steady load is maintained when the second needle is further inserted into the second sealing member, the second steady load being less than the second peak load, wherein either the first peak load is different than the second peak load or the first steady load is different than the second steady load, wherein the first needle and the second needle are configured to receive the first peak load and the second peak load, respectively, such that the second needle receives the second peak load after the first needle receives the first peak load, wherein a greater of the first peak load and a sum load of the second peak load and the first steady load is less than a greater of the second peak load and a sum load of the first peak load and the second steady load, wherein a total load received by the first needle and the second needle when the first needle and the second needle are being inserted into the first sealing member and the second sealing member, respectively, is equal to or less than the greater of the first peak load and a sum load of the second peak load and the first steady load, wherein the apparatus main body further comprises:

an attachment detector configured to send a signal in response to the liquid cartridge attaching to the attaching portion;

a needle moving mechanism configured to cause the first needle and the second needle to move such that the first needle and the second needle insert into the first sealing member and the second sealing member, respectively; and a controller configured to control the needle moving mechanism such that the needle moving mechanism operates based on the signal sent by the attachment detector, wherein the needle moving mechanism comprises:

a base, the first needle and the second needle extending from the base parallel to each other; and a base moving mechanism configured to move the base such that the first needle and the second needle move in a direction to insert into the first sealing member and the second sealing member, respectively, and wherein the second needle receives the second peak load after the first needle receives the first peak load based on a length of each of the first needle and the second needle in a direction in which the first needle and the second needle extend from the base.

* * * * *